United States Patent [19]

Taylor

[11] Patent Number: 4,919,219

[45] Date of Patent: Apr. 24, 1990

[54] REMOTELY ADJUSTABLE FISHING JAR

[76] Inventor: William T. Taylor, P.O. Box 309, Warren, Tex. 77664

[21] Appl. No.: 299,227

[22] Filed: Jan. 23, 1989

[51] Int. Cl.[5] ..... E21B 31/107

[52] U.S. Cl. ..... 175/299; 166/178; 175/303

[58] Field of Search ..... 175/299, 300, 302, 303; 166/178

[56] References Cited

U.S. PATENT DOCUMENTS

| | | | |
|---|---|---|---|
| 2,013,127 | 9/1935 | Bowen | 175/303 |
| 2,199,969 | 5/1940 | Hamm | 175/303 |
| 3,050,131 | 8/1962 | Siracusa et al. | 175/303 |
| 3,685,598 | 8/1972 | Nutter | 175/302 |
| 3,880,249 | 4/1975 | Anderson | 175/302 |
| 4,333,542 | 6/1982 | Taylor | 175/299 |
| 4,553,614 | 11/1985 | Jurgens et al. | 175/302 |
| 4,662,460 | 5/1987 | Loeb et al. | 175/300 X |
| 4,688,649 | 8/1987 | Buck | 175/299 |
| 4,694,917 | 9/1987 | Heidemann et al. | 175/299 |

*Primary Examiner*—Hoang C. Dang
*Attorney, Agent, or Firm*—J. Peppers

[57] ABSTRACT

A jar tool for inclusion into a well fishing operating string which provides resilient tensional stretch to operate the tool. The tool is adapted to compress an upper release spring to store energy corresponding to tensional force in the operating string forces. A release latching lug array connects the spring to a central mandrel having an impact hammer. The tool housing forms an impact anvil. The spring is compressed to a designated compressional force by the distance that the latch lug array is moved before suddenly releasing the spring from the mandrel. The tension in the operating string then pulls the mandrel hammer into jarring impact with the housing anvil. The provision is made for designating this pre-release movement of the latching lug array and also provides remotely actuated apparatus for adjusting the distance of the pre-release movement and thereby the compressional force imparted into the spring.

12 Claims, 2 Drawing Sheets

REMOTELY ADJUSTABLE FISHING JAR

BACKGROUND OF THE INVENTION

This invention generally relates to downhole well jar apparatus as utilized in the drilling and related operations for oil and gas wells. More specifically, the invention pertains to an advance in well jars of the mechanical type as exemplified by the tools disclosed in the prior art.

Well jar apparatus is generally provided of the mechanical type as herein disclosed and of the hydraulic type as well.

The principal disadvantage of the hydraulic type well jars is that they become overheated with continuouo use and become either ineffective or inoperative due to the heat. On the other hand, most of the mechanical type jars are difficult to adjust, if adjustable, to provide a designated jar impact force. Also, when the impact force of the jar can be adjusted, the jar must be adjusted at the earth's surface for any readjustment. Also, the latching or triggering mechanisms in mechanical jars, such as spherical balls for example are subject to very rigorous wear and deformation forces. Such forces limit the useful term of these mechanical jars between their rebuild or replacement.

The presently known prior art are the following: Beck No. 1989,906, Phipps No. 2,122,751, Kennedy et al No. 2,166,299, Howard No. 2,634,102, Andrews No. 2,882,018, Anderson No. 3,880,249, and Taylor No. 4,333,542.

OBJECTS OF THE INVENTION

An important object of the present invention is to provide a well jar which can be adjusted from the earth's surface while located in a well bore to produce an impact force which may be remotely adjustable from the earth's surface through the operating string;

Another object of the invention is to provide a latching mechanism wihin the well jar which can latch and contain a large compressive force which is released many hundreds of times without undue wear or parts deformation;

Another object of the present invention is to provide a well jar which will operate compatibly with conventional fishing tolls and jar accelerators.

SUMMARY OF THE INVENTION

The foregoing and other objects and advantages of the invention are provided in a remotely adjustable fishing jar apparatus having an operating mandrel reciprocatively mounted within a housing body with the mandrel and the body being adapted to be connected into a fishing operating string. The mandrel and the body form an impact hammer and an impact anvil for creating an upwardly directed impact force. An impact release spring is adapted to be compressed between the mandrel and the body responsive to tension applied to the mandrel. A releasable lug array latching mechanism is conneced between the mandrel and an adjustable loading adjustment sleeve for compressing the release spring a designated distance. The lug array is released when moved past a release position established by the loading adjustment sleeve. The sudden release of the impact release spring translates to sudden upward movement of the mandrel and causes impact of the hammer with the anvil responsive to the tensional force in the operating string. The loading adjustment sleeve is adjustably threaded into the housing body for rotation to cause designated changes in compressional force in the release spring proportionate to changes in the axial position of the adjustment sleeve. The adjustment sleeve forms a continuous reciprocative elongated J-slot formed to cause rotation of the adjustment sleeve response to axial reciprocation of a lug within this slot in both a first and a second direction. A preset sleeve is mounted around the mandrel and forms the lugs to cause the lugs to reciprocate within the slots when the mandrel is axially moved from a relatching and release position (used to operate the jar) into a reset position. A relatching spring device is included to bring the latching lug array to a relatch position for the mandrel to bring the lug array back to a latched position. The releasable lug array is an annular body including a plurality of arcuate lug segments providing substantially a full circle of compressional area of support between circumferential areas provided by the mandrel and by the loading adjustment sleeve to latch the compression spring during compression. The lug segments are continuously confined longitudinally by an upper spring loading sleeve disposed in compression between the lug segments and the release spring and a lower relatching sleeve disposed between the latching lugs and the relatching spring.

DESCRIPTION OF A PREFERRED EMBODIMENT

Figure 1A:
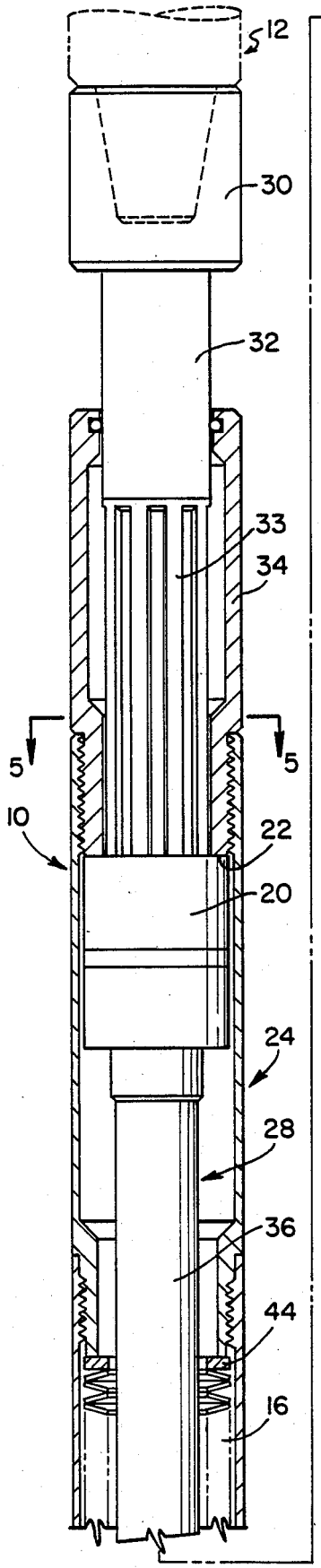
FIGS. 1A and 1B constitute a partly schematic, longitudinal cross section of the full length of the jar tool with its central operating mandrel being illustrated in elevation.
Figure 1B:
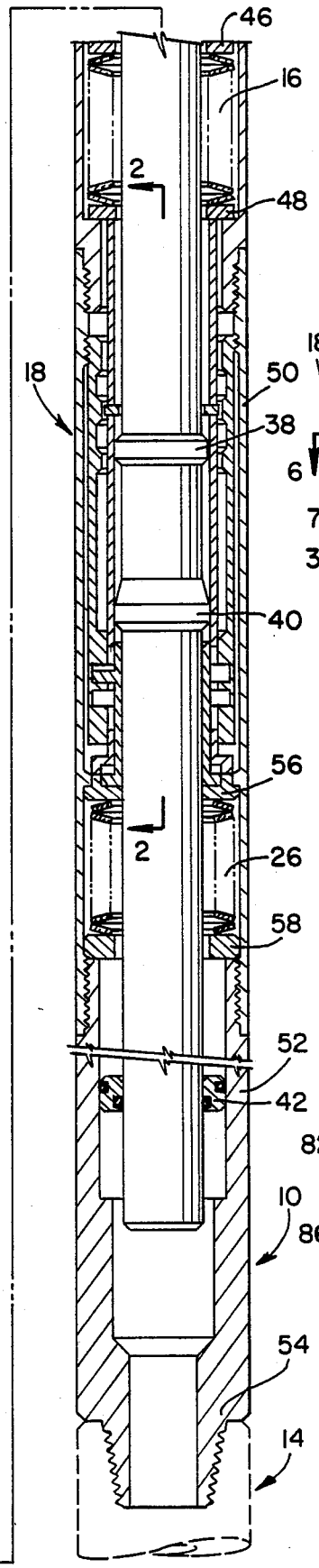

As an initial general description of the jar tool as shown in FIGS. 1A and 1B, the tool 10 can be manufactured in several sizes. For example, the tool 10 may be provided from $1\frac{7}{8}$" OD to 3" OD, or greater for operation from a wire line as the operating string. These sizes can be adapted to carry electrical conductors as needed.

With well tubing or drillpipe as the operating string, the tool 10 can be provided in several sizes ranging from $1\frac{7}{8}''$ OD to 0" OD, as examples.

The tool 10 as shown is connected into an upper operating string 12 and to apparatus 14 below which constitutes the "fish" or apparatus to be pulled up from a possibly stuck or lodged position in the well bore.

The tool 10 tends to extend in length responsive to tensional force applied to the operating string 12 from the earth's surface. The operating string may also include a jar accelerator (not shown) which provides additional resilient stress to the operating string responsive to tensional force. The operating string as a whole also stretches along its length.

While the tool 10 is being extended in length by a tensional force, an upper release spring 16 is compressed accordingly and stores energy corresponding to the operating string stretch force. A releasing latch lug device 18 connects the release spring 16 to a central mandrel 28 which extends out of housing 24 as the spring 16 is compressed.

An impact hammer 20 is connected to the mandrel 28 and adapted to strike a anvil 22 formed with housing 24 (as the latch lug assembly 18 suddenly releases the spring 16 from compression).

The tensional force placed in the operating string 12 to overcomes the compressional force in release spring 16 is suddenly applied to very rapidly pull the mandrel 28 and attached hammer 20 into impact with the anvil 22 to create an upwardly jarring impact force by the tool 10 to the fish 14.

The latching lug device 18 is recocked by spring 26 as the operating string 12 is lowered to lower the mandrel 28 into a relatched position with the latch lug device 18.

The release spring 16 is compressed to a designated compressional force by the distance that the latch lug is moved before releasing the spring 16. The present invention provides for designating this pre-release movement of latching lug 18 and also provides remotely adjustable apparatus for adjusting the distance of the pre-release movement and thereby the compressional force imparted into release spring 16.

Depending to some extent on the size of the jar tool 10 and the travel distance of the hammer 20 to impact anvil 22, the impact force of the hammer against the anvil may be in the range of 4.0 to 4.3 times the compressive force released from spring 16. Thus, a compressive force of 500 lbs. in the spring 16 will cause an impact force of 2100 lbs of impact force, for example. In the $3\frac{5}{8}''$ OD size, for example, a compressive force of 3300 lbs. will result in an impact force of roughly 14,00 lbs.

Figure 5:
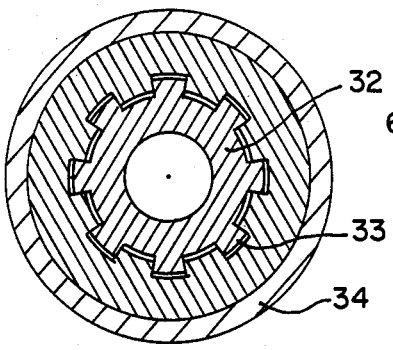
FIG. 5 is a lateral cross section of the tool taken at line 5-5 of FIG. 1A.

The jar tool 10 is seen to include an upper connection sub 30 adapted for connection to the operating string 12 and connected to the spline section 32 of the mandrel 28. The spline section 32 connects through splines 33 into spline sub 34 as shown in FIG. 5.

The spline sub 32 also connects with the hammer 20 carried by the mandrel 28. The sub 34 and anvil 22 is connected to form a part of the body 24. The lower mandrel 36 is connected as part of the overall mandrel 28 to the hammer 20 and extends down through the tool 10. The lower mandrel 36 carries a beveled latch lug land 38 located above a beveled adjustment land 40. At the lower end of mandrel 38 is shown a lower floating liquid seal 42 disposed between the mandrel 38 and a body seal housing 52.

The release spring 16 is seen to be composed of a plurality of Bellville springs disposed in precompression between an upper impact spring seat 44 and a lower spring seat 48. Disposed near the center of the spring 16 is an intermediate impact spring guide 46 as shown. The latch release mechanism, as best shown in FIG. 2, is housed in a body spring and latch section 50 of the body 24.

A lower connection sub 54 of the body 24 is adapted for connection into a fish section 14 as previously mentioned.

It is to be noted that the tool 10 is adapted to be filled with a liquid which is provided primarily to keep the inner most parts of the tool 24 free of dirt and debris. The tool 1 0 does not depend on hydraulic fluid for operation but is benefited by the fluid which serves as a lubricant and an isolation fluid. It is to be noted that the fluid within the tool 10 remains at a pressure equal to the pressure in the well bore by virtue of the floating piston 42 found in the lower section 52. "O" ring seals in section 34 and the floating piston 42 as shown are conventional and not described further herein.

Figure 2:
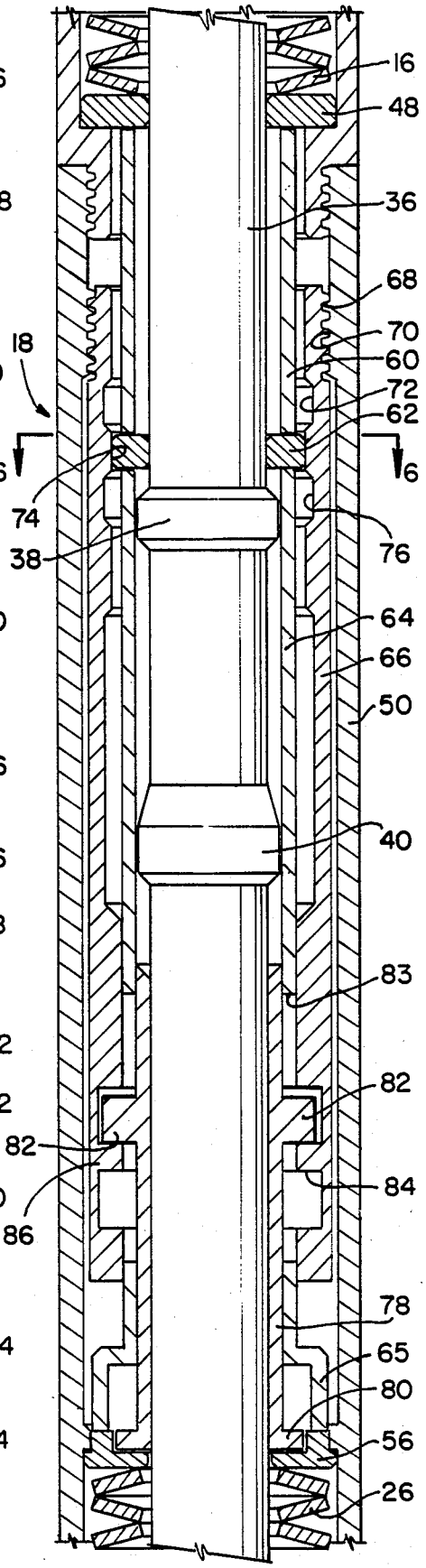
FIG. 2 is an enlarged longitudinal cross section of the tool taken between the arrows 2—2 of FIG. 1B.

A recocking spring 26, also composed of Belleville springs as shown, is supported at its upper end by a reset and adjustment seat 56 and a lower reset spring seat 58 as best shown in FIGS. 1B and 2.

While the structure of the latching lug arrangement 18 is shown in both FIGS. 1B and 2, the description is best followed with reference to FIG. 2. As shown in FIG. 2, the latching arrangement 18 is housed in the body section 50 of the body 24 and extends from the upper spring 16 to the recocking spring 26.

As shown the annular lug array 62 is longitudinally confined between an upper loading sleeve 60 extending between the lug array 62 and the spring seat 48 of release spring 16. Below the lug array 62 is a lower loading sleeve between the lug array 62 and the reset seat 56 of the recocking spring 26. The latch lugs 63 (best shown in FIG. 6) are gripped through the upper loading sleeve 60 and the lower loading sleeve 64 by the compressional force of the release spring 16 and the recocking spring 26. As shown, the lower loading sleeve 64 is provided with a radial offset 65 in order to directly contact the recocking spring reset sea 56 without interference of a preset sleeve 78 as later described.

It is to be noted that the springs 26 and 16, acting through the offset 65 and the spring seat 48, maintain the lug array 62 in centered position on a beveled latch lug land 74. The latch lug land 38 on the mandrel 36 is located immediately below the lug array 62 as shown in FIG. 2 and this is in the cocked position.

It is to be noted that the loading adjustment sleeve 66 is in threaded connection with the housing body 50 through corresponding threads 68 and 70. It is to be seen that the further that the adjustment sleeve 66 is threaded upwardly in the body 50, there is a further distance for the latch lug array 62 to travel before reaching the beveled latch lug groove 72.

As mandrel 36 and latch land 38 are pulled in tension upwardly, the land 38 engages the lower beveled side of the latch lug array 62. Movement of the operating string 12 and the central mandrel 28 and mandrel section 36 moves the latching land 38 into forceful contact with the latch lug aray 62 and translates the upward movement through the latch array 62, the upper loading sleeve 60, and the spring seat 48 to compress the spring 16. The deflection of spring 16 during its compression requires a designated force for each deflection increment of compression.

At such time as sufficient compression has been applied through the latch array 62 as described, the lugs 62 reach the bevel between the latch land 74 and the groove 72. When the latch lugs 63 reach the lug groove 72, the lugs 63 suddenly expand into the lug groove 72 and permit the latch land 38 to substantially instantaneously move upwardly in response to the tensional force imposed by the operating string 12 to carry the hammer 20 into forceful impact against the anvil 22 to the fish 14 through the body 24.

As now described, the adjustment sleeve 66 is seen to have a thread 68 threadedly connected into a housing thread 70 such that rotation of the sleeve 66 will move it upwardly or downwardly, depending on the direction of rotation. The adjustment sleeve 66 forms a latch lug release groove 72, a latch lug land 74 and a reset lug groove 76 as shown. In cocked position, the latch lug array 62 is carried on the latch lug land 74 and held in the same position by the spring 16 and the reset spring 26 acting through the upper loading sleeve 60 and the lower loading sleeve 64.

The latch lug land 38 of the mandrel section 36 is below the latch lug array 62 when the tool 10 is in a "cocked" position. Upward movement of the latch land 38 moves the latch array 62 to compress the release spring 16 until such time as the latch array 62 suddenly expands into the latch lug groove 72 and thereby releases the mandrel section 36 for upward travel in response to the tension applied in the operating string 12.

The compressional stress in release spring 16, when suddenly released, immediately expands the spring to bring the spring seat 48 down into contact with its support shoulder. Concurrently, the upward support sleeve 60 brings the lugs 63 down and back on the latch land 74 to return the assembly to the condition shown in FIG. 4.

Now taking FIGS. 1A, 1B, and 2 in reference in FIGS. 5, 6, 7 and 8, it is evident that the mandrel assembly 28 is all in splined relation to the housing 24 and thereby to the fish string 14. Consequently, all the parts shown in FIG. 2 remain in splined and non-rotating position with respect to the mandrel section 36 and the housing section 50 with exception of the loading adjustment sleeve as later described.

Figure 6:
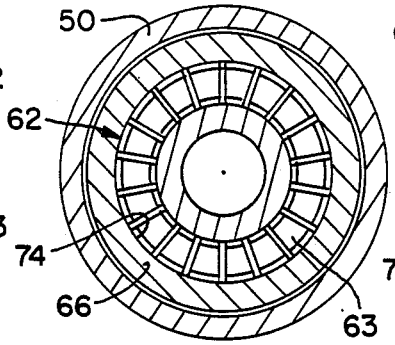
FIG. 6 is a lateral cross section of the jar tool taken at line 6—6 of FIG. 2.
Figure 3:
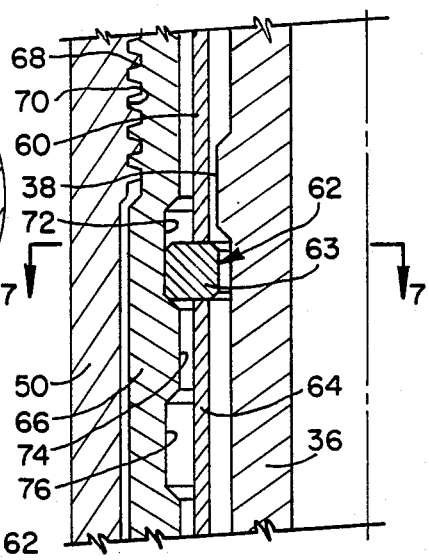
FIG. 3 shows a segment of FIG. 2 showing parts of the jar tool at a designated instant during the operation of the jar tool.
Figure 7:
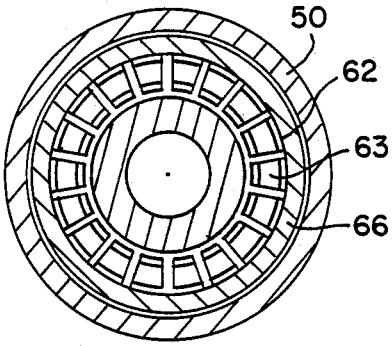
FIG. 7 is a lateral cross section of the tool taken at line 7—7 of FIG. 3.
Figure 8:
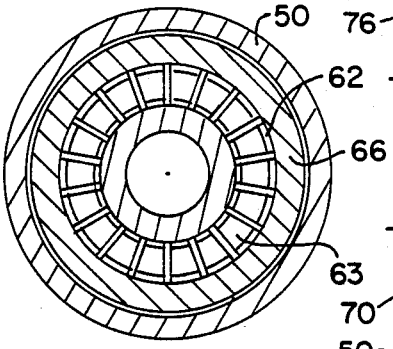
FIG. 8 is a lateral cross section of the tool taken at line 8—8 of the FIG. 4.

The section of FIG. 6 illustrates the lug array 62 in its centered position on the latch lug land 74 of the adjustment sleeve 66 before firing. FIG. 7 shows the latch lug array 62 expanded into the latch lug groove 72 as shown in FIG. 3 during firing. FIG. 8 shows the lugs 63 or the array 62 again centered into the reset lug groove 76 prior to the reset procedure described with reference to FIG. 4.

The compressive force imposed in release spring 16 by its compressive displacement (by spring seat 48 and upper loading sleeve 60 from the latch lug array 62) is varied by threaded adjustment of the adjustment sleeve 66 through its threads 68 into the housing thread 70. As seen, the further that the adjustment sleeve 66 is threaded upwardly in the housing 50, the further the lug array 62 must travel in order to move off the latch lug land 74 and escape outwardly into the latch lug groove 72.

This upwardly (or downwardly) movement of the adjustment sleeve 66 is accomplished through the operating string 12 and the mandrel 28 by a sleeve adjustment land 40 formed by the mandrel section 36 of mandrel 28. As shown in FIG. 2, the adjustment land 40 is disposed above a preset (or reset) adjustment sleeve 78. The present sleeve 78 carries two reset cam pins 82 which extend through slots 83 formed in the lower loading sleeve 64 into reset cam grooves 84 formed in the lower part of the adjustment sleeve 66.

As shown, the reset adjustment sleeve 78 extends downwardly to terminate with a sleeve flange 80 which is in bearing contact with the recock spring guide 56 and in communication thereon with the recock spring 26. When the sleeve adjustment land 40 reaches an upper bevel in the reset adjustment sleeve 78, further movement carries the adjustment sleeve 78 down and thereby compresses the recocking spring 26. The cam pins 82 move downwardly in a continuous slot 84 as carried by the adjustment sleeve 66.

Figure 9:
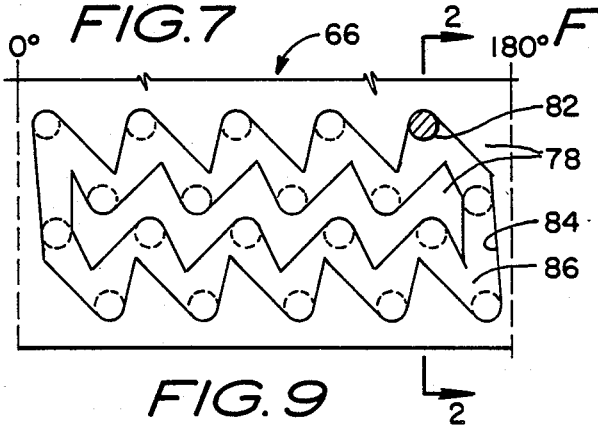
FIG. 9 is a rolled out representation taken around 180° of the inner radius of an impact adjustment sleeve of the jar as best shown in FIG. 2 and showing the profile of one of two oppositely disposed motion transfer slots formed into the inner face of the adjustment sleeve.

One of the two reset cam grooves 84 is best shown in the illustration shown in FIG. 9. A line 2—2 is shown across FIG. 9 to illustrate the position of the cam pins 82 in the cam groove 84. As also shown in FIGS. 2 and 9, there is a cam groove web 86 which keeps the parts of sleeve 66 encompassed by the cam groove 84 as an integral part of the adjustment sleeve 66.

The groove or slot 84 is seen to be a continuation of successive J-slots in which the cam lug 82 moves. The cam lug 82 is rotationally fixed such that reciprocation of cam lug 84 causes the adjustment sleeve 66, which forms the cam groove 84, to move to the right with the first five reciprocations, as shown in FIG. 9, then return to the left to begin again with the second five reciprocations. It is noted that two of these slots 84 are formed in opposite sides of adjustment sleeve 66 and two cam lugs 82 are powered on opposite sides of the reset adjustment sleeve 78. It is noted that the continuing groove 84 extends slightly less than 180° around the inside of adjustment sleeve 66.

It is also noted that the adjustment slot 84 in adjustment sleeve 66 can be proided to be continuous to nearly 360° before returning to its beginning. In this situation only one cam lug 82 would be utilized and the adjustment reciprocation could rotate the adjustment sleeve 66 through nearly a full turn of thread 68 in thread 70.

Figure 10:
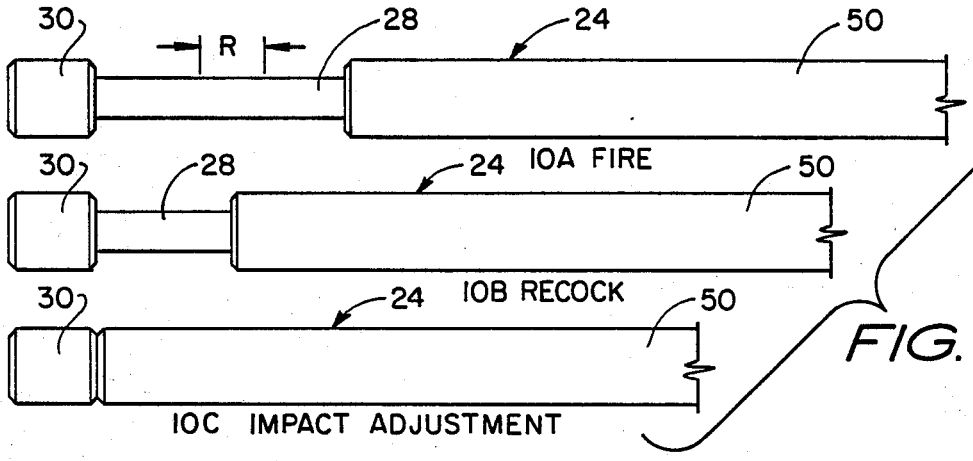
FIG. 10 is an illustration of the extension of the operating mandrel out from the jar tool at designated phases of operation.

FIG. 10 further illustrates the relative positions of the mandrel 28 and the housing body 24 at different phases of the operation of tool 10. FIG. 10A illustrates the position of the mandrel 28 within the housing body 24 at the instant of firing of the jar tool 10 at which time the hammer 20 is impacting or jarring against the anvil 22 as shown in FIG. 1A. At this instant, the land 38 has passed the array 62 as shown in FIG. 3.

FIG. 10B is shown during the recocking procedure of the mandrel latch land 38 as later described with reference to FIG. 2.

FIG. 10C illustrates the tool 10 during the time that the impact adjustment of the housing 66 is in progress and when the reset land 40 on the mandrel section 36 has pushed the reset sleeve 78 to its lower most position and the sleeve flange 80 to a lower most position in compression of the recocked spring 26.

FIGS. 2 and 9 show the location of the pins 82 at a time when the adjustment land 40 is withdrawn above and free of the reset sleeve 78.

The cam pins 82 are held in their upper most position within the reset cam groove 84 by compressional force exerted by the reset spring 26. It is seen that each time that the reset land 40 is brought down to push down the reset sleeve 78, the cam pins 82 also move downwardly and against a slope in the cam groove 86 and thereby rotate the adjustment sleeve 66 until the cam pins 82 have reached a lower most position in that particular portion of the cam agroove 84. As the reset land is moved upwardly (along with mandrel section 36) the reset spring 26 pushes the reset sleeve 78 upwardly which causes the cam pins 82 to move upwardly against an opposing side of the slot or groove 84 and this movement translates into further rotation of the adjustment sleeve 66 until the pins again are in an upper most position as shown in FIG. 9.

It is seen that the cam groove 84 is continuous where five reciprocations of the cam pins 82 has rotated the adjustment sleeve 66 slightly less than 180 degrees. And also as seen further reciprocation of the pins 82 will rotate the sleeve 66 back to its original position as shown in FIG. 9.

The thread pitch of thread 68 and 70 are calibrated with respect to the position of release land 74 such that the increments of rotation of the adjustment sleeve 66 will result in corresponding designated increments of compressive force applied to the release spring 66. This compressive force will be suddenly released when the latch array 62 expands into the latch lug groove 72.

The pitch of the threads 68–70 may be of a pitch from four turns per inch to ten turns per inch, for example. The pitch of the threads 68, the compressive rate of the release springs 16 and the distance traveled by the latch lug land 38 to trigger the latch array 62 are all designated by one skilled in the art.

OPERATION OF THE PREFERRED EMBODIMENT

Figure 4:
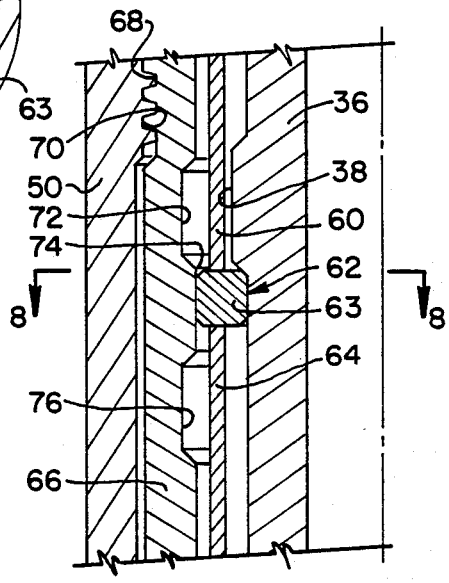
FIG. 4 is the same segment as shown in FIG. 3 at another designated instant during the operation of the jar tool.

Referring now to FIGS. 2–4 the tool 10 is shown in cocked position in FIG. 2 for delivering a jarring or impact force to a fish 14 in response to tensional force applied through the operating string 12. The hammer 20 is moved a maximum distance down from anvil 20.

As tensional force is applied to the operating string 12, the mandrel 28 and mandrel section 36 is pulled upwardly until the latch lug land is in forceful contact with the latch lug array 62. As further tension is applied by the string 12, the latching array 62 is moved upwardly by the latch lug land 38 and the lug array 62 begins to move off the latch lug land 74. The compression of the release spring 16 corresponds to the total movement of the connected lug array 62 upper loading sleeve 60 and impact spring seat 48.

At such time as the lug array 62 moves off of the latch lug land 74, it virtually instantaneously travels downn the bevel of the lug groove 62 and consequently permits the individual lugs 63 of the lug array 62 to move outwardly into the lug groove 72. Such movement increases the internal clearance of the lug array 62 and permits the almost instantaneous travel of the lug land 38 to move upwardly. FIG. 3 shows the relative position of the parts almost instantaneously after the lug array 62 has expanded into the lug groove 72 to permit the lug land 38 virtually instantaneous release.

When suddenly relieved of the force imposed by the release spring 16, the mandrel 28 is instantaneously responsive to be moved by the tensional force applied to the operating spring 12. This tensional force pulls the hammer 20 upwardly at high velocity to impact the anvil 22 and transmit this impact loading into an upward impact or jar of the tool 24 to the fish 14.

The pre-release force provided by the release spring 16 is, of course, in proportion to the distance traveled by the lug array 62 along the lug land 74 before release of the lugs 63.

As previously mentioned, the impact force of the hammer 20 against the anvil 22 may be designated variously. It has been found empirically that the impact force of the hammer against the anvil may be in the range of 4.1 to 4.3 times the force released by the release spring 16. Thus, a compressive force of 500 lbs. in the release spring 16 will cause an impact force of 2100 lbs. of impact force, for example. In the $3\frac{5}{8}''$ OD size, for example, a compressive force of 3300 lbs. in release spring 16 will result in an impact force of roughly 14000 lbs. by hammer 20 against the anvil 22 of the body 24.

To recock the jar tool 10 the mandrel 28, including the mandrel section 36 and the latch land 38, is moved downwardly. As shown in FIG. 4 the springs 16 and 26 have almost instantaneously repositioned and centered the lug array 62 on the lug land 74. As the mandrel section 36 and the latch lug land 38 is moved downwardly, it forces the land lug array 62 also downwardly until the lugs 63 of the array 62 is moved off of the lug land 74 into the reset lug groove 76. When the lugs 63 are allowed to expand into the lug groove 76 the latch land 38 moves on past the lug array 62 and the reset spring 26 immediately snaps the lug array 62 back into its cocked position on the lug land 74 as shown in FIG. 2. The line 8-8 of FIG. 4 shows the position of the lug array 62 as shown in corresponding FIG. 8. The recocked position of lug array 62 is, of course, again shown in FIG. 6.

REMOTE IMPACT ADJUSTMENT OF THE PREFERRED EMBODIMENT

When adjustment is to be made the tool will be in the posture as shown in FIG. 2 and 10B. The distance as shown in FIG. 10A is the distance traveled by the mandrel 28 to recock the jar for further use.

When the tool 10 is compressed as shown in FIG. 10C the adjustment land 40 has encountered the adjustment 78 sleeve and pushed it downwardly against the compressive force of spring 26 until the pins 82 are in one of the downward positions shown in FIG. 9.

At the earth's surface a weight indicator connected to the operating string 12 can indicate by differences in weight of the operating string 12 when the mandrel is fully extended as shown in FIG. 10A and when it is fully retracted as shown in FIG. 10C. An operator experienced in this art can manipulate the operating string by using the draw works (not shown) to reciprocate the mandrel 28 through the distance R as shown in FIG. 10A to adjust the impact distance of the threads 60 and 70.

In this instance, the operator brings the tool 10 down as shown in FIG. 10C and then brings the tool upwardly a necessary few inches to reciprocate the pins 82 along the grooves 84. For example, the distance between the extreme upward position between the pins 82 in the groove 84 can be 1000 lbs. difference in compression of the release spring 16 with appropriate rotation of the adjustment sleeve 66.

If the operator wishes to change the deflection settng of the release spring 16 the amount of 2000 lbs. then he will move the pins 82 from the position shown in FIG. 9 downwardly and upwardly two distinct times. The fishing tool fishing string operator has a "feel" for manipulation of the operating string and can thereby determine with reference to the weight indicator and other factors such as the kind of operating string, the depth of fish in the well bore, and the like, to make this adjustment reliably.

It is, of course, seen that the first five upward positions of the pins 82 in the groove 84 will increase or decrease the compressive setting in an upward or downward fashion and then the successive five reciprocations will serve to return the previous settings in the opposite direction.

It will be obvious to those skilled in the art that the embodiment as herein described may be modified or changed and yet remain in the spirit of the invention and the purview of the appended claims.

That being claimed is:

1. A remotely adjustable downhole fishing jar apparatus comprising:

(a) an operating mandrel reciprocatively mounted within a housing body with said mandrel and said body adapted to be connected into a well bore operating string;

(b) said mandrel and said body forming an impact hammer and an impact anvil for creating an upwardly directed impact force;

(c) an impact release spring adapted to be compressed between said mandrel and said body responsive to tension applied to said mandrel by said operating string;

(d) a releasable lug array latching means connected between said mandrel and an adjustable loading adjustment sleeve for compressing said release spring a designated distance with a designated movement of said mandrel until said lug array is released when moved past a release position set by said loading adjustment sleeve;

(e) said sudden release of said impact release spring translating to sudden upper movement of said mandrel responsive to the tensional force in said operation string to cause impact of said hammer with said anvil;

(f) said loading adjustment sleeve being adjustably threaded into said housing body for rotation to cause designated changes in compressional force in said release spring proportionate to changes in longitudinal position of said adjustment sleeve;

(g) said adjustment sleeve forming a continuous elongated reciprocation cam slot formed to cause rotation of said adjustment sleeve responsive to longitudinal reciprocation of adjustment cam lug within said cam slot; and (h) a preset sleeve mouned around said mandrel and forming at least one said cam lug to cause said cam lug to reciprocate within said slot when said mandrel is longitudinally moved from a relatching and release position used to operate said jar into a separate reset position where said cam lug can be reciprocated.

2. The apparatus of claim 1 further including a relatching spring means to bring said latching lug array to a relatch position.

3. The appratus of claim 2 wherein said releasable lug array is formed of a plurality of arcuate lug segments providing substantially a full circle of compressional area of support between circumferential areas formed respectively by said mandrel and said loading adjustment sleeve.

4. The apparatus of claim 3 wherein said lug segments are longitudinally confined by an upper spring loading sleeve disposed in compression between said lug segments and said release spring, and a lower spring loading sleeve disposed between said lug segments and said relatching spring.

5. A remotely adjustable downhole fishing jar apparatus including an operating mandrel reciprocatively mounted within a housing body with said mandrel and said body adapted to be connected into a well bore operating string, said mandrel and said body forming an impact hammer and an impact anvil for creating an upwardly directed impact force, an impact release spring adapted to be compressed between said mandrel and said body responsive to tension applied to said mandrel by said operating string, the combination comprising:

(a) a releasable lug array latching means connected between said mandrel and an adjustable loading adjustment sleeve for compressing said release spring a designated distance with a designated movement of said mandrel until said lug array is released when moved past a release position set by said loading adjustment sleeve;

(b) said loading adjustment sleeve being adjustably threaded into said housing body for rotation to cause designated changes in compressional force in said release spring proportionate to changes in longitudinal position of said adjustment sleeve;

(c) said adjustment sleeve forming a continuous elongated reciprocation cam slot formed to cause rotation of said adjustment sleeve responsive to longitudinal reciprocation of an adjustment cam lug within said cam slot;

(d) a preset sleeve mouned around said mandrel and forming at least one said cam lug to cause said cam lug to reciprocate within said slot when said mandrel is longitudinally moved from a relatching and release position used to operate said jar into a separate reset position where said cam lug is reciprocated; and (e) a relatching spring means to bring said latching lug array to a relatch position for said mandrel to bring said lug array back to a latched position.

6. The apparatus of claim 5 wherein said releasable lug array is formed of a plurality of arcuate lug segments providing substantially a full circle of compressional area of support between circumferential areas formed respectively by said mandrel and said loading adjustment sleeve.

7. The apparatus of claim 1 wherein said reciprocation cam slot is formed as two rows of a continuing J-slot extending in a first direction for a designated number of reciprocation of the said cam lug to rotate said adjustment sleeve in a first direction and a return continuing J-slot for said designated number of reciprocations to rotate said sleeve in a return direction.

8. The apparatus of claim 7 including two of said J-slots and two of said cam lugs to rotate said adjustment sleeve slightly less than 180° in each direction of rotation.

9. The apparatus of claim 7 wherein said J-slot extends slightly less than 360° and includes a single cam lug to rotate said adjustment sleeve in said first direction and subsequently to rotate said sleeve in said return direction.

10. The apparatus of claim 5 wherein said reciprocation cam slot is formed as two rows of a continuing J-slot extending in a first direction for a designated number of reciprocations of the said cam lug to rotate said adjustment sleeve in a first direction and a return continuing J-slot for said designated number of reciprocations to rotate said sleeve in a return direction.

11. The apparatus of claim 10 wherein said two rows of said J-slots and said cam lugs rotate said adjustment sleeve slightly less than 180° in each direction of rotation.

12. The apparatus of claim 1 wherein said reciprocation cam slot is formed as two rows of a continuing J-slot extending in a first direction for a designated number of reciprocation of the said cam lug to rotate said adjustment sleeve in a first direction and a return continuing J-slot for said designated number of reciprocations to rotate said sleeve in a return direction and including two of said J-slots and two of said cam lugs to rotate said adjustment sleeve slightly less than 180° in each direction of rotation.

* * * * *